US008571433B2

(12) United States Patent
Hori et al.

(10) Patent No.: US 8,571,433 B2
(45) Date of Patent: Oct. 29, 2013

(54) ROLL SUPPORTING MECHANISM, IMAGE FORMING APPARATUS AND ASSEMBLY BODY

(75) Inventors: Satoru Hori, Kanagawa (JP); Takafumi Yoneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 518 days.

(21) Appl. No.: 12/891,448

(22) Filed: Sep. 27, 2010

(65) Prior Publication Data

US 2011/0211872 A1 Sep. 1, 2011

(30) Foreign Application Priority Data

Mar. 1, 2010 (JP) ..... 2010-044197

(51) Int. Cl.
*G03G 15/00* (2006.01)

(52) U.S. Cl.
USPC ..... 399/90; 399/176; 399/313

(58) Field of Classification Search
USPC ..... 399/90, 115, 131, 176, 279, 285, 313
See application file for complete search history.

(56) References Cited

U.S. PATENT DOCUMENTS 6,064,841 A 5/2000 Matsuzaki et al.

FOREIGN PATENT DOCUMENTS

| | | | |
|---|---|---|---|
| JP | 9-319239 A | | 12/1997 |
| JP | 10186897 A | * | 7/1998 |
| JP | 10-207185 A | | 8/1998 |
| JP | 11352808 A | * | 12/1999 |
| JP | 2006330352 A | * | 12/2006 |

* cited by examiner

*Primary Examiner* — David Gray
*Assistant Examiner* — Laura Roth
(74) *Attorney, Agent, or Firm* — Sughrue Mion, PLLC

(57) ABSTRACT

A roll supporting mechanism rotatably supports an electrically-conducted roll. The roll supporting mechanism includes an electrically-conducting portion that contacts with a circumferential portion of an outer periphery of the electrically-conducted roll to conduct electricity to the electrically-conducted roll, and an insulating portion that contacts with the other circumferential portion of the outer periphery of the electrically-conducted roll at a contact portion smaller than a contact portion of the electrically-conducting portion and that is formed by an insulating material.

11 Claims, 11 Drawing Sheets

ROLL SUPPORTING MECHANISM, IMAGE FORMING APPARATUS AND ASSEMBLY BODY

CROSS-REFERENCE TO RELATED APPLICATION

This application is based on and claims priority under 35 USC 119 from Japanese Patent Application No. 2010-044197 filed Mar. 1, 2010.

BACKGROUND

Technical Field

The present invention relates to a roll supporting mechanism, an image forming apparatus and an assembly body.

SUMMARY

The present invention provides a roll supporting mechanism an image forming apparatus and an assembly body, which reduces a rotational resistance of an electrically-conducted roll while ensuring reliability of electrical conduction between an electrically-conducting portion and an electrically-conducted roll.

A roll supporting mechanism according to a first aspect of the invention rotatably supports an electrically-conducted roll, the roll supporting mechanism including an electrically-conducting portion that contacts with one circumferential portion of an outer periphery of the electrically-conducted roll to conduct electricity to the electrically-conducted roll, and an insulating portion that contacts with another circumferential portion of the outer periphery of the electrically-conducted roll at a contact portion smaller than a contact portion of the electrically-conducting portion and that is formed by an insulating material.

BRIEF DESCRIPTION OF THE DRAWINGS

Exemplary embodiments of the present invention will be described in detail based on the following figures, wherein.

DETAILED DESCRIPTION

An example of an exemplary embodiment according to the present invention is hereinafter described with reference to the attached drawings.

Figure 1:
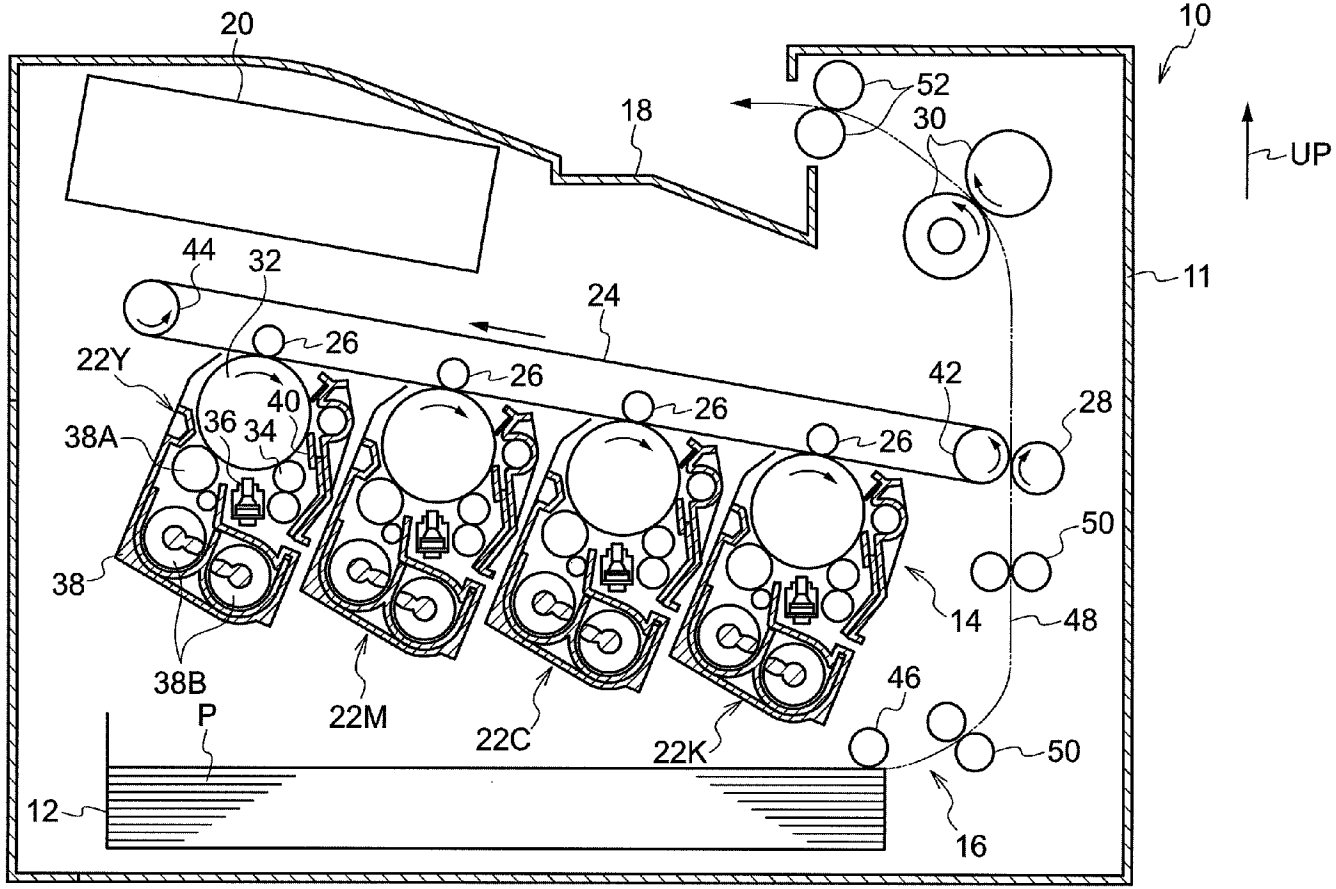
FIG. 1 is a schematic view showing the structure of an image forming apparatus according to an exemplary embodiment of the invention.

Structure of Image Forming Apparatus According to an Exemplary Embodiment of the Invention First, the structure of an image forming apparatus according to an exemplary embodiment of the invention is described. FIG. 1 is a schematic view showing the structure of the image forming apparatus according to an exemplary embodiment of the invention. Note that arrow UP shown in FIG. 1 shows an upper side in the vertical direction.

As shown in FIG. 1, an image forming apparatus 10 includes an image forming apparatus main body 11 in which various components are accommodated.

Provided within the image forming apparatus main body 11 are: a recoding medium accommodating portion 12 in which recording medium P such as paper is accommodated, an image forming portion 14 in which an image is formed on a recording medium P, a transport portion 16 in which the recording medium P is transported from the recording medium accommodating portion 12 to the image forming portion 14, and a control portion 20 which controls the operation of each of various portions of the image forming apparatus 10. Further, a recording medium discharging portion 18 in which a recoding medium P on which an image is formed by the image forming portion 14 is provided at the upper side of the image forming apparatus main body 11.

The image forming portion 14 includes: image forming units 22Y, 22M, 22C and 22K (hereinafter indicated as 22Y to 22K) which allow formation of toner images of yellow (Y), magenta (M), cyan (C) and black (K); an intermediate transfer belt 24 which is an example of transfer body to which toner images formed by the image forming units 22Y to 22K are transferred; a first transfer roll 26 (an example of an electrically-conducted roll) which is an example of a first transfer member for transferring, to the intermediate transfer belt 24, a toner image formed by the image forming units 22Y to 22K; a second transfer roll 28 which is an example of a second transfer member for transferring the toner image transferred by the first transfer roll 26 to the intermediate transfer belt 24 from the intermediate transfer belt 24 to the recording medium P; and a fixing device 30 which causes the toner image transferred by the second transfer roll 28 from the intermediate transfer belt 24 to the recording medium P to be fixed on the recording medium P.

The image forming units 22Y to 22K are arranged in the central portion in the vertical direction of the image forming apparatus 10 in the state of being inclined with respect to the horizontal direction. Further, the image forming units 22Y to 22K each have a photoreceptor 32 serving as an image holding body for holding an image and rotating in one direction (in a clockwise direction in FIG. 1). Incidentally, the image forming units 22Y to 22K is structured in the same way, and therefore, in FIG. 1, the reference numerals of corresponding portions in the image forming units 22M, 22C and 22K are omitted.

Provided around each photoreceptor 32 from an upstream side in a rotating direction of the photoreceptor 32 are a charging roll 34 which is an example of charging device for charging the photoreceptor 32, an exposure device 36 which causes the photoreceptor 32 charged by the charging roll 34 to be exposed, so as to form an electrostatic latent image on the photoreceptor 32, a developing device 38 which develops the electrostatic latent image formed by the exposure device 36 on the photoreceptor 32 to form a toner image, and a toner removing device 40 which removes a toner remaining in the photoreceptor 32 after the toner image formed on the photoreceptor 32 is transferred to the intermediate transfer belt 24.

The exposure device 36 is adapted to form an electrostatic latent image based on an image signal transmitted from the control portion 20. Examples of the image signal transmitted from the control portion 20 include an image signal that the control portion 20 acquires from an external device.

The developing device 38 includes a developer supplying body 38A which supplies a developer to the photoreceptor 32 and plural transport members 38B each which agitate and transport a developer supplied to the developer supplying body 38A.

As shown in FIG. 1, the intermediate transfer belt 24 is formed circularly and disposed at the upper side of the image forming units 22Y to 22K. Winding rolls 42, 44 on which the intermediate transfer belt 24 is wound are provided at the inner periphery side of the intermediate transfer belt 24. The intermediate transfer belt 24 is adapted to circularly move (rotate) in one direction (in a counterclockwise direction in FIG. 1) due to the rotation of one of the winding rolls 42, 44 while it contacts with the photoreceptors 32.

The winding roll 42 is provided as an opposed roll which faces the second transfer roll 28.

Further, the intermediate transfer belt 24 forms an intermediate transfer unit 45 together with the winding rolls 42, 44 and a supporting body 43 which supports the winding rolls 42, 44 in a rotatable manner.

Figure 2:
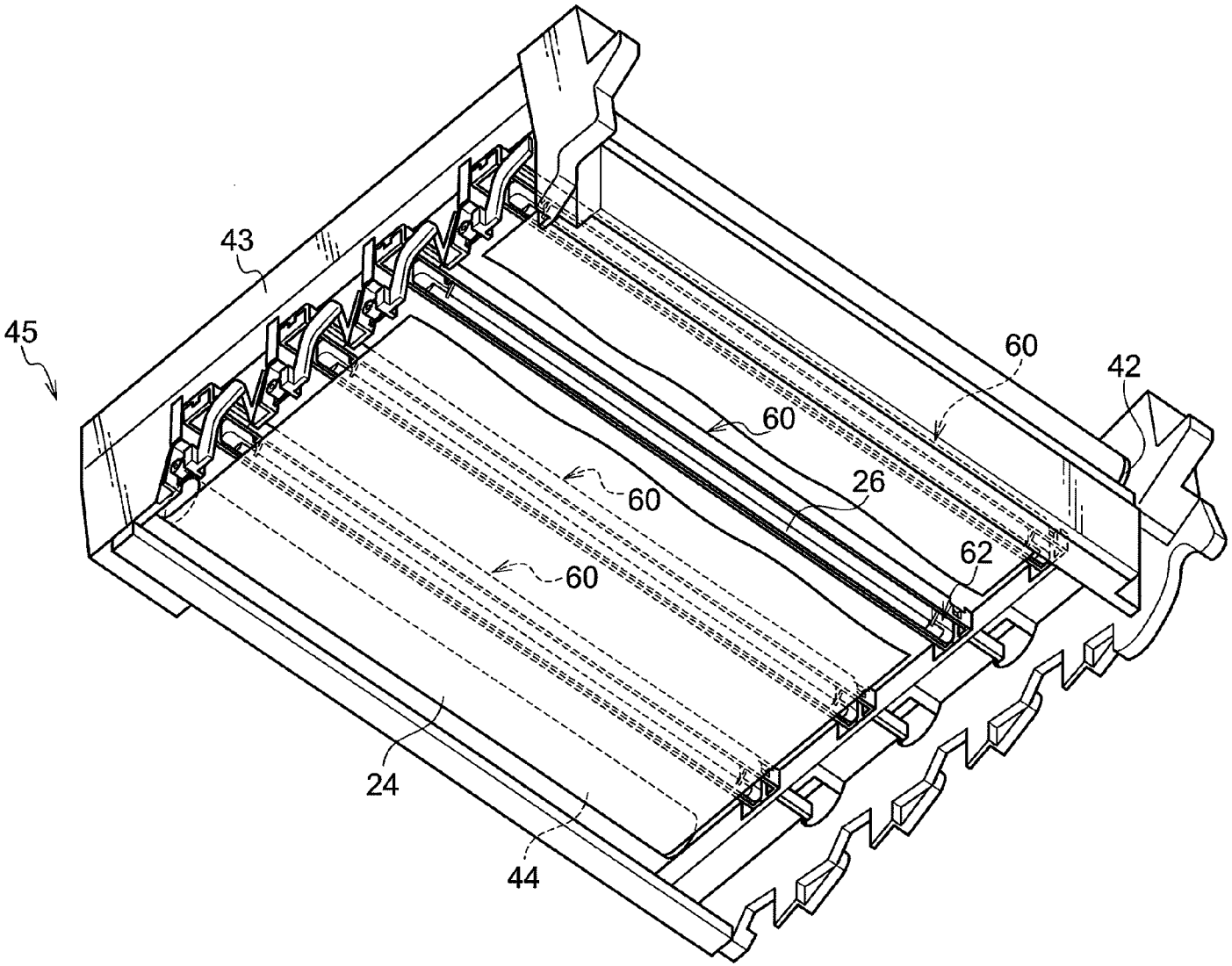
FIG. 2 is a schematic perspective view showing the structure of an intermediate transfer unit according to an exemplary embodiment of the invention.

As shown in FIG. 2, the intermediate transfer unit 45 is provided so as to be removable with respect to the image forming apparatus main body 11, and forms an example of assembly body (process cartridge) which is assembled integrally with the image forming apparatus main body 11 in a removable manner.

The supporting body 43 of the intermediate transfer unit 45 also supports transfer units 60, which will be described later, and the image forming units 22Y to 22K. The intermediate transfer unit 45 includes the intermediate transfer belt 24, the transfer units 60 and the image forming units 22Y to 22K, and is formed so as to be removable with respect to the image forming apparatus main body 11.

The first transfer roll 26 faces the photoreceptor 32 with the intermediate transfer belt 24 interposed therebetween. A position between the first transfer roll 26 and the photoreceptor 32 is set as a first transfer position at which a toner image formed on the photoreceptor 32 is transferred to the intermediate transfer belt 24. Further, the first transfer roll 26 contacts with the intermediate transfer belt 24 and is adapted to rotate so as to follow the intermediate transfer belt 24 which circularly moves.

As shown in FIG. 1, the first transfer roll 26 forms the transfer unit 60 which is an example of a transfer device together with a roll supporting mechanism 62 which supports the first transfer roll 26. Incidentally, a specific structure of the transfer unit 60 is described later.

The second transfer roll 28 faces the winding roll 42 with the intermediate transfer belt 24 being interposed therebetween. A position between the second transfer roll 28 and the winding roll 42 is set as a second transfer position at which a toner image transferred to the intermediate transfer belt 24 is transferred to the recording medium P.

The transport portion 16 includes a delivery roll 46 which delivers a recording medium P accommodated in the recording medium accommodating portion 12, a transport path 48 through which the recording medium P delivered by the delivery roll 46 is transported, and plural transport rolls 50 disposed along the transport path 48 and transporting the recording medium P delivered by the delivery roll 46 to the second transfer position.

The fixing device 30 is disposed further toward the downstream side in the transport direction than the second transfer position, and causes a toner image transferred at the second transfer position to be fixed on the recording medium P. Provided further toward the downstream side in the transport direction than the fixing device 30 is exhaust rolls 52 which discharge the recording medium P with the toner image being fixed thereon, to the recording medium discharging portion 18.

Next, an image forming operation for forming an image on the recording medium P in the image forming apparatus 10 according to the exemplary embodiment of the invention is described.

In the image forming apparatus 10 according to the exemplary embodiment of the invention, the recording medium P delivered from the recording medium accommodating portion 12 by the delivery roll 46 is delivered to the second transfer position by the plural transport rolls 50.

In each of the image forming units 22Y to 22K, the photoreceptor 32 charged by the charging roll 34 is exposed by the exposure device 36 and an electrostatic latent image is formed on the photoreceptor 32. The electrostatic latent image is developed by the developing device 38 and a toner image is formed on the photoreceptor 32. Toner images of various colors formed by the image forming units 22Y to 22K are superimposed at the first transfer position on the intermediate transfer belt 24, whereby a color image is formed. Then, a color image formed on the intermediate transfer belt 24 is transferred to the recording medium P at the second transfer position.

The recording medium P to which the toner image is transferred is transported to the fixing device 30, and the transferred toner image is fixed by the fixing device 30. The recording medium P on which the toner image is fixed is discharged by the exhaust rolls 52 to the recording medium discharging portion 18. As described above, a series of image forming operations is carried out.

Figure 3:
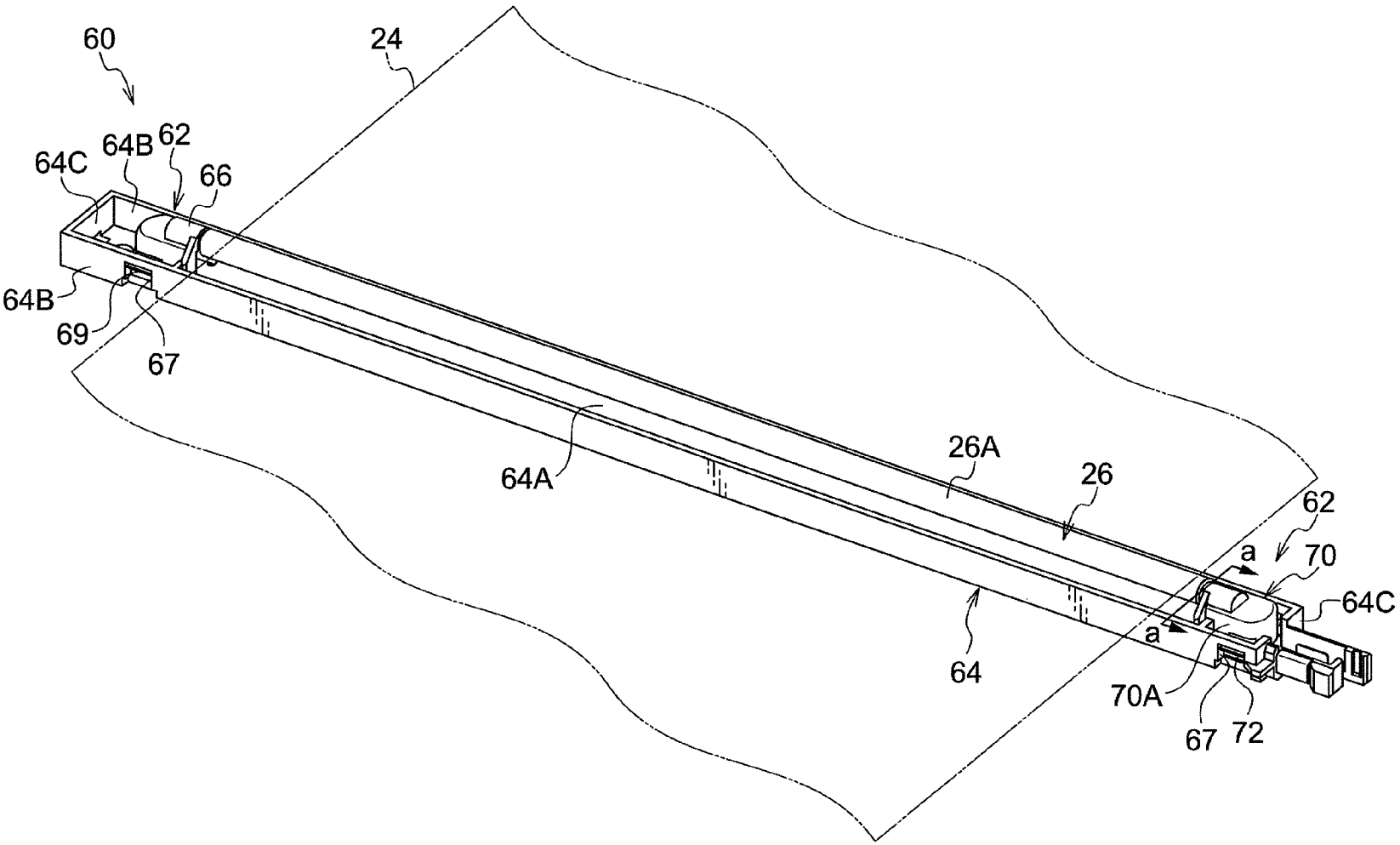
FIG. 3 is a schematic perspective view showing the structure of a transfer unit according to an exemplary embodiment of the invention.

Structure of Transfer Unit 60 According to an Exemplary Embodiment of the Invention Next, the structure of the transfer unit 60 according to the exemplary embodiment of the invention is described. FIG. 3 is a schematic perspective view showing the structure of the transfer unit 60 according to the exemplary embodiment of the invention.

As shown in FIG. 3, the transfer unit 60 includes the first transfer roll 26 which is an example of an electrically-conducted roll, the roll supporting mechanism 62 which supports the first transfer roll 26, and a unit main body 64 in which the roll supporting mechanism 62 is provided.

Figure 4:
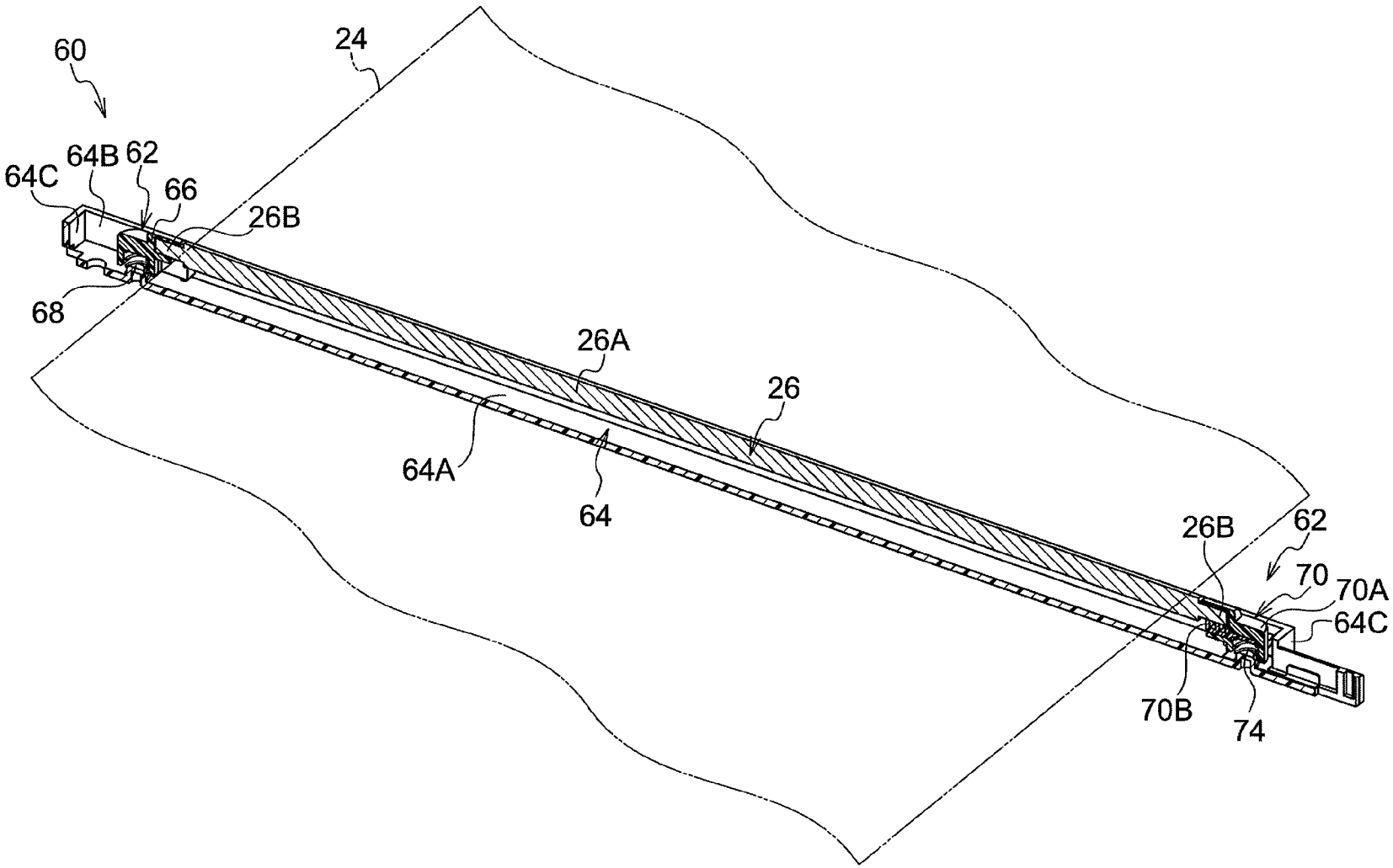
FIG. 4 is a schematic cross sectional view showing the structure of a transfer unit according to an exemplary embodiment of the invention.

As shown in FIG. 4, the first transfer roll 26 includes a circular cylinder-shaped roll main body 26A, and a pair of shaft portions 26B which are formed integrally with both end portions of the roll main body 26A in the axial direction and of which diameter is smaller than that of the roll main body 26A. The roll main body 26A and the pair of shaft portions 26B are each made of a conductive material having a conductive property, specifically, made from metal.

The first transfer roll 26 is charged in such a manner that a voltage is applied thereto from an outside, and electrostatic power based on the charging causes a toner of the photoreceptor 32 (see FIG. 1) to be transferred to the intermediate transfer belt 24. One end side (at the right end side in FIG. 4) of the first transfer roll 26 is set as a voltage application side to which a voltage is applied, and the other end side (at the left end side in FIG. 4) of the first transfer roll 26 is set as a non-voltage-applied side to which no voltage is applied.

As shown in FIG. 3, the unit main body 64 is entirely formed into a box with the side (the upper side in FIG. 3) facing the intermediate transfer belt 24 opened. Specifically, the unit main body 64 is formed by and includes an opposed wall 64A (a bottom wall disposed at the lower side in FIG. 3) which faces the intermediate transfer belt 24 via the first transfer roll 26, a pair of side walls 64B formed integrally with the opposed wall 64A along the axial direction of the first transfer roll 26, and a pair of second side walls 64C which are respectively formed integrally with the opposed wall 64A and the first side walls 64B at both end sides of the first transfer roll 26 in the axial direction.

The opposed wall 64A, the first side walls 64B and the second side walls 64C are each formed into a plate, and the longitudinal direction of the opposed wall 64A and the first side walls 64B coincides with the axial direction of the first transfer roll 26.

Figure 5:
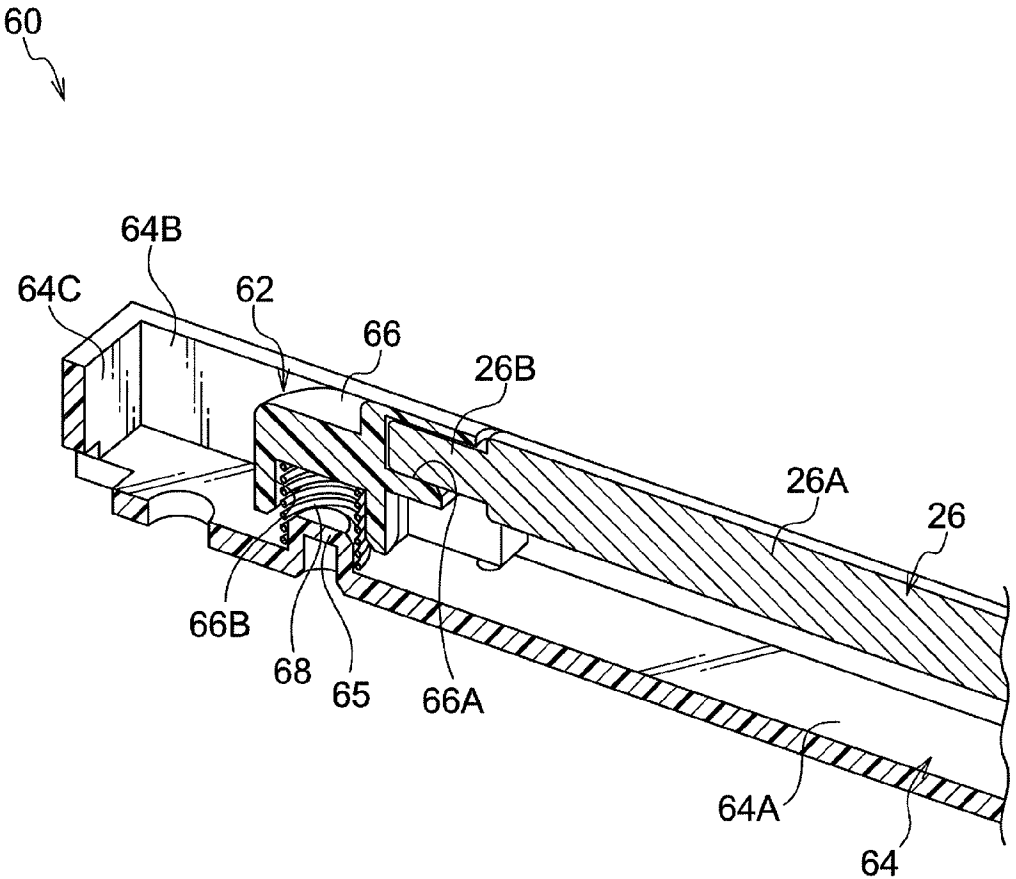
FIG. 5 is an enlarged view of an end portion of the transfer unit, at the side of no voltage being applied, in the structure shown in FIG. 4.
Figure 6:
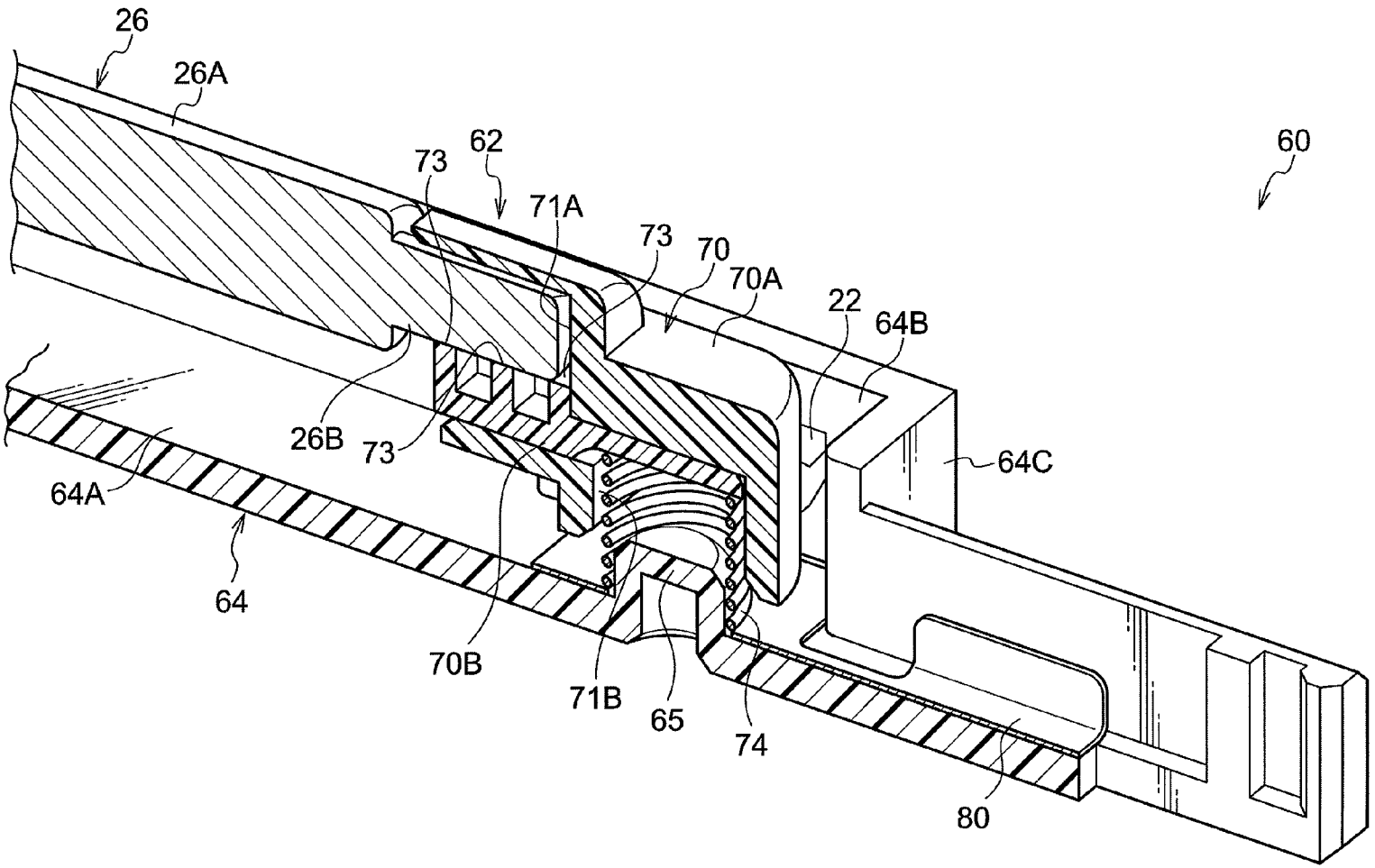
FIG. 6 is an enlarged view of an end portion of the transfer unit, at the side of a voltage being applied, in the structure shown in FIG. 4.

Openings 67, in which projecting pieces 69 and 72, described later, are fit, are respectively formed in both end portions of the pair of first side walls 64B in the longitudinal direction. Further, as shown in FIG. 5 and FIG. 6, a convex portion 65 projecting from the opposed wall 64A toward the intermediate transfer belt 24 (to the upper side in FIGS. 5 and 6) is respectively formed at both end portions of the opposed wall 64A in the longitudinal direction.

As shown in FIG. 4, the roll supporting mechanism 62 includes a supporting body 66 which rotatably supports the shaft portion 26B at the first transfer roll 26 side having no voltage applied (at the left side in FIG. 4), and a compression coil spring 68 which is an example of pressing member which presses the first transfer roll 26 against the intermediate transfer belt 24 via the supporting body 66.

The supporting body 66 disposed at the side with no voltage being applied thereto is made of an insulating material (for example, an insulating resin) having an insulating property. The insulating property in the supporting body 66 means an insulating property which is demonstrated to such a degree that a short circuit from the shaft portion 26B does not propagate to a member having a conductive property, which member is disposed at the outer side in the radial direction of the shaft portion 26B (for example, the axial-direction end portion of the photoreceptor 32). Specifically, the volume resistivity of the supporting body 66 is at least made higher than that of an electrically-conducting member 70B which will be described later.

As shown in FIG. 3, the supporting body 66 at the side having no voltage being applied thereto includes a projecting piece 69 which projects toward each of the first side walls 64B, and the projecting piece 69 is fit in the opening 67 formed in each of the first side walls 64B, whereby the supporting body 66 is mounted to the unit main body 64. A clearance is formed between the projecting piece 69 fit in the opening 67 and each of the first side walls 64B, and in the range that the projecting piece 69 can move within the opening 67, the supporting body 66 can be moved in the axial direction of the first transfer roll 26 and in a direction in which the supporting body 66 moves close to or away from the intermediate transfer belt 24.

As shown in FIG. 5, a concave insertion portion 66A in which the shaft portion 26B of the first transfer roll 26 is inserted is formed at the first transfer roll 26 side of the supporting body 66 at the side having no voltage being applied thereto. The first transfer roll 26 is adapted to rotate in such a manner that the shaft portion 26B is inserted in the insertion portion 66A and the shaft portion 26B moves to slide within the insertion portion 66A. Namely, the supporting body 66 is made to serve as a slide bearing which rotatably supports one end portion of the first transfer roll 26 in the axial direction.

A concave accommodating portion 66B in which the compression coil spring 68 is accommodated is formed at the opposed wall 64A side of the supporting body 66 having no voltage being applied thereto. The compression coil spring 68 is mounted between the supporting body 66 and the opposed wall 64A in such a manner that the convex portion 65 of the opposed wall 64A is inserted from one end side of the spring in the axial direction (from the lower end side in FIG. 5) in a hollow portion of the spring and the compression coil spring 68 is accommodated from the other end side in the axial direction (from the upper end side in FIG. 5) in the accommodating portion 66B of the supporting body 66. The compression coil spring 68 mounted between the supporting body 66 and the opposed wall 64A is adapted to press the first transfer roll 26 against the intermediate transfer belt 24 by pushing the supporting body 66 to the intermediate transfer belt 24 side (to the upper side in FIG. 5). The accommodating portion 66B formed in the supporting body 66 is displaced off to the outer side in the axial direction of the first transfer roll 26 (to the left side in FIG. 5) with respect to the insertion portion 66A. As a result, the compression coil spring 68 presses the first transfer roll 26 against the intermediate transfer belt 24 via the supporting body 66 at the position displaced off to the outer side in the axial direction of the first transfer roll 26.

Further, as shown in FIG. 4, the roll supporting mechanism 62 includes a supporting body 70 which rotatably supports the shaft portion 26B of the first transfer roll 26 at the side having a voltage applied thereto (at the right side in FIG. 4), and a compression coil spring 74 which presses the first transfer roll 26 against the intermediate transfer belt 24 via the supporting body 70.

As shown in FIG. 6, the supporting body 70 at the side having a voltage applied thereto includes two components, that is, an insulating member 70A which is an example of an insulating portion formed by an insulating material having an insulating property (for example, an insulating resin), and an electrically-conducting member 70B which is an example of an electrically-conducting portion which conducts electricity to the first transfer roll 26. The electrically-conducting member 70B is formed by a conductive material having a conductive property (for example, a conductive resin), and is disposed within the insulating member 70A. For example, polyacetal resin (POM) is used as the insulating member 70A, and a conductive polyacetal resin (conductive POM) is used as the electrically-conducting member 70B.

The insulating property in the insulating member 70A means an insulating property which is demonstrated to such a degree that a short circuit from the shaft portion 26B does not propagate to a member having a conductive property, which member is disposed at the outer side in the radial direction of the shaft portion 26B (for example, the axial-direction end portion of the photoreceptor 32). Specifically, the volume resistivity of the insulating member 70A is at least made higher than that of the electrically-conducting member 70B.

As shown in FIG. 3, the insulating member 70A of the supporting body 70 includes the projecting piece 72 which projects toward each of the first side walls 64B. The supporting body 70 is mounted to the unit main body 64 in such a manner that the projecting piece 72 is fit in the opening 67 formed in each of the first side walls 64B. A clearance is formed between the projecting piece 72 fit in the opening 67 and each of the first side walls 64B, and in the range that the projecting piece 72 can move within the opening 67, the supporting body 70 can be moved in the axial direction of the first transfer roll 26 and in the directions in which the supporting body 70 moves close to and away from the intermediate transfer belt 24.

As shown in FIG. 6, a concave insertion portion 71A, in which the shaft portion 26B of the first transfer roll 26 is inserted, is formed in the insulating member 70A of the supporting body 70 at the first transfer roll 26 side. Further, a concave accommodating portion 71B, in which a compression coil spring 74 is accommodated, is formed at the opposed wall 64A side of the insulating member 70A.

The insertion portion 71A and the accommodating portion 71B are connected with each other along the axial direction of the first transfer roll 26. The electrically-conducting member 70B is disposed along the axial direction of the first transfer roll 26 so as to extend over the insertion portion 71A and the accommodating portion 71B.

In the state in which the electrically-conducting member 70B is disposed in the insertion portion 71A and in the accommodating portion 71B, one end portion of the electrically-conducting member 70B (the left end portion thereof in FIG. 6) is positioned in the insertion portion 71A at the opposed wall 64A side with respect to the shaft portion 26B, and the other end (the right end portion in FIG. 6) is positioned in the accommodating portion 71B at the intermediate transfer belt 24 side with respect to the compression coil spring 74.

The electrically-conducting member 70B contacts with one circumferential portion of the outer periphery of the shaft portion 26B at the opposed wall 64A side (at the lower side of the shaft portion in FIG. 6), and the insulating member 70A contacts with the other circumferential portion of the outer periphery of the shaft portion 26B at the intermediate transfer belt 24 side (a portion other than the above-described one portion of the outer periphery of the shaft portion), whereby the first transfer roll 26 is rotatably supported by the electrically-conducting member 70B and the insulating member 70A. The first transfer roll 26 is adapted to rotate by sliding with respect to the insulating member 70A and the electrically-conducting member 70B. Namely, the supporting body 70 (the electrically-conducting member 70B and the insulating member 70A) is made to serve as a slide bearing which rotatably supports one end portion of the first transfer roll 26 in the axial direction.

Figure 7:
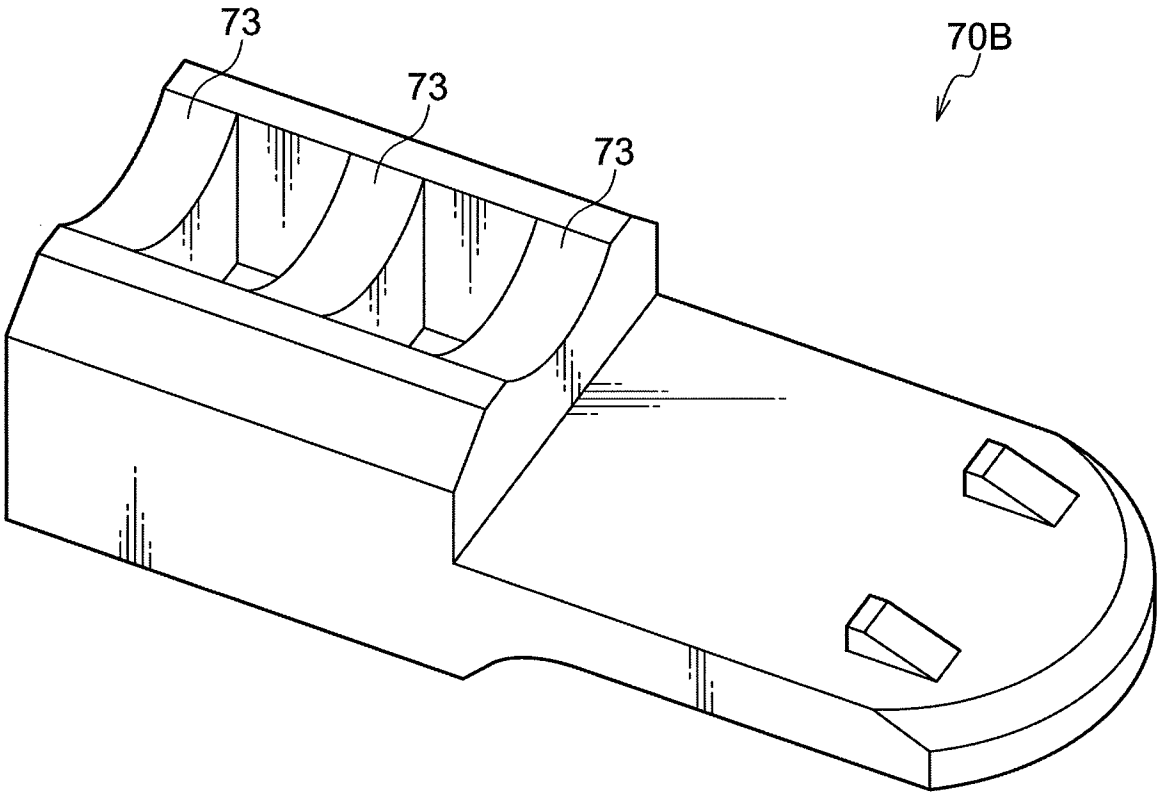
FIG. 7 is a schematic perspective view showing the structure an electrically conducting member according to an exemplary embodiment of the invention.

As shown in FIG. 7, the electrically-conducting member 70B includes plural (specifically, three) contact portions 73, each of which contacts with the shaft portion 26B, formed along the axial direction of the shaft portion 26B.

Figure 8:
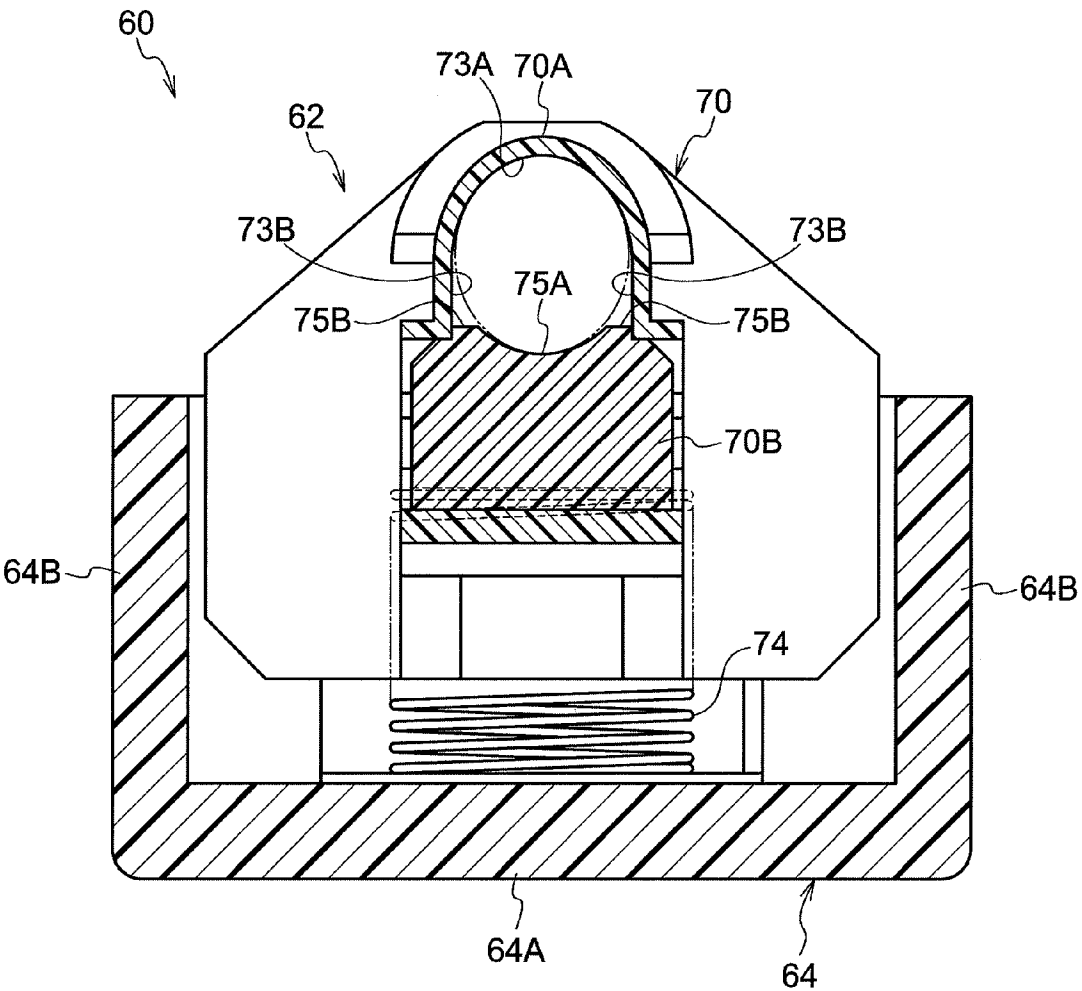
FIG. 8 is an explanatory view for explaining the shape of a hole formed by an electrically-conducting member and an insulating member.
Figure 9:
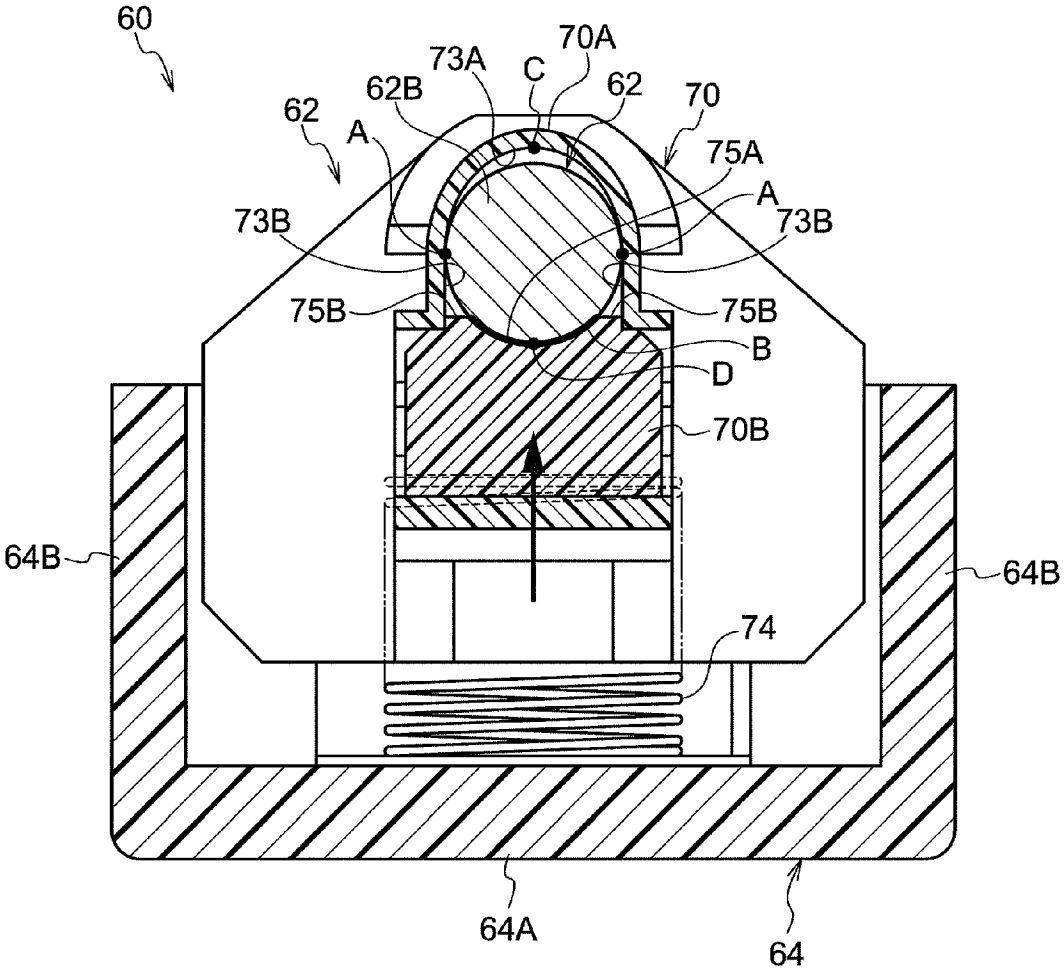
FIG. 9 is a cross sectional view taken along line a-a in FIG. 3.

Further, the hole shape of the insertion portion 71A formed by the insulating member 70A and the electrically-conducting member 70B is, as shown in FIG. 8, schematically formed into an oblong configuration (elliptical shape) which, when seen along the rotation-axis direction of the first transfer roll 26, is made longer in a direction in which the first transfer roll 26 moves close to and away from the intermediate transfer belt 24 (in the vertical direction in FIG. 8) (see the two-dot chain line in FIG. 8). Specifically, the hole shape of the insertion portion 71A formed by the insulating member 70A and the electrically-conducting member 70B is formed such that a distance between the top portion C and the bottom portion D in FIG. 9 is longer than a distance between contact portions at which the insulating member 70A contacts with the first transfer roll 26 (portions A in FIG. 9).

Specifically, when seen along the rotation-axis direction of the first transfer roll 26, the insulating member 70A has a curved surface portion 73A formed at the upper side of FIG. 8 with respect to the first transfer roll 26, and a pair of planar surface portions 73B which are formed linearly along the vertical direction in FIG. 8 and formed continuously from right and left sides of the curved surface portion 73A in FIG. 8 with respect to the first transfer roll 26. The curve surface portion 73A changes in the curvature thereof from one contact portion to the other contact portion (both contact portions are respectively indicated as portion A in FIG. 9), and at the least has a curvature larger than that of the outer periphery of the first transfer roll 26. Specifically, the curved surface portion 73A changes in the curvature thereof such that the curvature gradually becomes larger from the planar surface portions 73B side (from the lower side in FIG. 8) to the top portion C. The planar surface portions 73B may be formed as a curved surface portion whose curvature is smaller than that of the first transfer roll 26.

The insulating member 70A includes contact portions (portions A in FIG. 9) each of which contacts with the first transfer roll 26 at two boundary portions between each of the pair of planar surface portions 73B and the curved surface portion 73A. Other portion than the boundary portions is, although it faces the outer periphery of the first transfer roll 26, formed as a non-contact portion which does not contact with the outer periphery of the first transfer roll 26.

Further, when seen from the rotation-axis direction of the first transfer roll 26, the electrically-conducting member 70B includes a curved surface portion 75A curved along the outer periphery of the first transfer roll 26, and a pair of planer surface portions 75B facing to the upper side in FIG. 8 and formed continuously from the right and left sides of the curve surface portion 75A in FIG. 8, respectively. In the electrically-conducting member 70B, the curved surface portion 75A contacts with the outer periphery of the first transfer roll 26. The planar surface portions 74B are, although they face the outer periphery of the first transfer roll 26, each formed as a non-contact portion which does not contact with the outer periphery of the first transfer roll 26.

Incidentally, the conductive member 70B may entirely contact with the first transfer roll 26 without including the planar surface portion 75B. Further, the planar surface portions 75B may be formed as a curved surface portion which does not contact with the first transfer roll 26.

In this manner, as shown in FIG. 9, the contact portion that the first transfer roll 26 contacts with the insulating member 70A is made smaller than the contact portion that the first transfer roll 26 contacts with the electrically-conducting member 70B. Specifically, the first transfer roll 26 line-contacts with the insulating member 70A (see portion A in FIG. 9), and surface-contacts with the conductive member 70B (see portion B in FIG. 9). The non-contact portion of the insulating member 70A, which faces the outer periphery of the first transfer roll 26 and which does not contact with the outer periphery of the first transfer roll 26, is larger than that of the electrically-conducting member 70B.

The compression coil spring 74 is made from a conductive material having a conductive property, specifically, made from metal. Further, as shown in FIG. 6, the compression coil spring 74 is mounted between the insulating member 70A and the opposed wall 64A in such a manner that a convex portion 65 of the opposed wall 64A is inserted from one end side of the spring in the axial direction (from the lower end side in FIG. 6) into the hollow portion and the compression coil spring 74 is accommodated in the accommodating portion 71B of the insulating member 70A from the other end side in the axial direction (from the upper end side in FIG. 6). Further, the above-described other end portion of the electrically-conducting member 70B accommodated in the accommodating portion 71B (the right end portion in FIG. 6) is disposed between the insulating member 70A and the compression coil spring 74.

As a result, the compression coil spring 74 presses the first transfer roll 26 against the intermediate transfer belt 24 by pushing the electrically-conducting member 70B and the insulating member 70A to the first transfer roll 26 side (to the upper side in FIG. 6). Namely, the compression coil spring 74 serves as an example of a pressing member which presses the electrically-conducting member 70B against the first transfer roll 26 and also serves as a member which presses the first transfer roll 26 against the intermediate transfer belt 24.

The accommodating portion 71B formed in the insulating member 70A is displaced off to the outer side in the axial direction of the first transfer roll 26 with respect to the insertion portion 71A. As a result, the compression coil spring 74 presses the first transfer roll 26 against the intermediate transfer belt 24 via the electrically-conducting member 70B and the insulating member 70A at a position displaced off to the outer side in the axial direction of the first transfer roll 26.

Further, an electrically-conducting plate 80 which conducts electricity to the compression coil spring 74 is provided between the compression coil spring 74 and the opposed wall 64A. The electrically-conducting plate 80 is electrically connected via unillustrated wiring to an external power source (not shown) disposed outside of the transfer unit 60. As a result, electric power from the external power source is supplied to the first transfer roll 26 via the electrically-conducting plate 80, the compression coil spring 74 and the electrically-conducting member 70B.

Operation Relating to the Exemplary Embodiment of the Invention

Next, operation of the exemplary embodiment of the invention is described.

In the transfer unit 60 according to the exemplary embodiment of the invention, a voltage is applied from the external power source (not shown) to the first transfer roll 26 through the electrically-conducting plate 80, the compression coil spring 74 and the electrically-conducting member 70B. As a result, the first transfer roll 26 is charged and electrostatic power based on the charging causes a toner of the photoreceptor 32 to be transferred to the intermediate transfer belt 24.

The first transfer roll 26 contacts with the intermediate transfer belt 24 and is driven to rotate by circular movement of the intermediate transfer belt 24.

Here, in the present exemplary embodiment, the contact portion that the insulating member 70A of the supporting body 70 contacts with the first transfer roll 26 is made smaller than the contact portion that the electrically-conducting member 70B contacts with the first transfer roll 26. For this reason, compared to a case in which the contact portion that the insulating member 70A contacts with the first transfer roll 26 is larger than the contact portion that the electrically-conducting member 70B contacts with the first transfer roll 26, the rotational resistance of the first transfer roll 26 is reduced while reliability of electric conduction between the electrically-conducting member 70B and the first transfer roll 26 is ensured.

Further, in the present exemplary embodiment, the electrically-conducting member 70B is pressed by the compression coil spring 74 against the first transfer roll 26, and therefore, compared to a case in which the electrically-conducting member 70B is not pressed against the first transfer roll 26, reliability of electric conduction between the electrically-conducting member 70B and the first transfer roll 26 can be ensured.

Moreover, in the present exemplary embodiment, the compression coil spring 74 presses the electrically-conducting member 70B against the first transfer roll 26 further toward the outer side in the rotation-axis direction of the first transfer roll 26 than the position at which the first transfer roll 26 and the electrically-conducting member 70B contact with each other. Therefore, compared to a case in which the electrically-conducting member 70B is pressed against the first transfer roll 26 at the position at which the first transfer roll 26 and the electrically-conducting member 70B contact with each other, the dimension of the roll supporting mechanism 62 along the radial direction of the first transfer roll 26 becomes smaller.

Through the use of the compression coil spring 68 which presses the electrically-conducting member 70B against the first transfer roll 26, the first transfer roll 26 is pressed against the intermediate transfer belt 24, and therefore, the number of parts does not increase.

Figure 10:
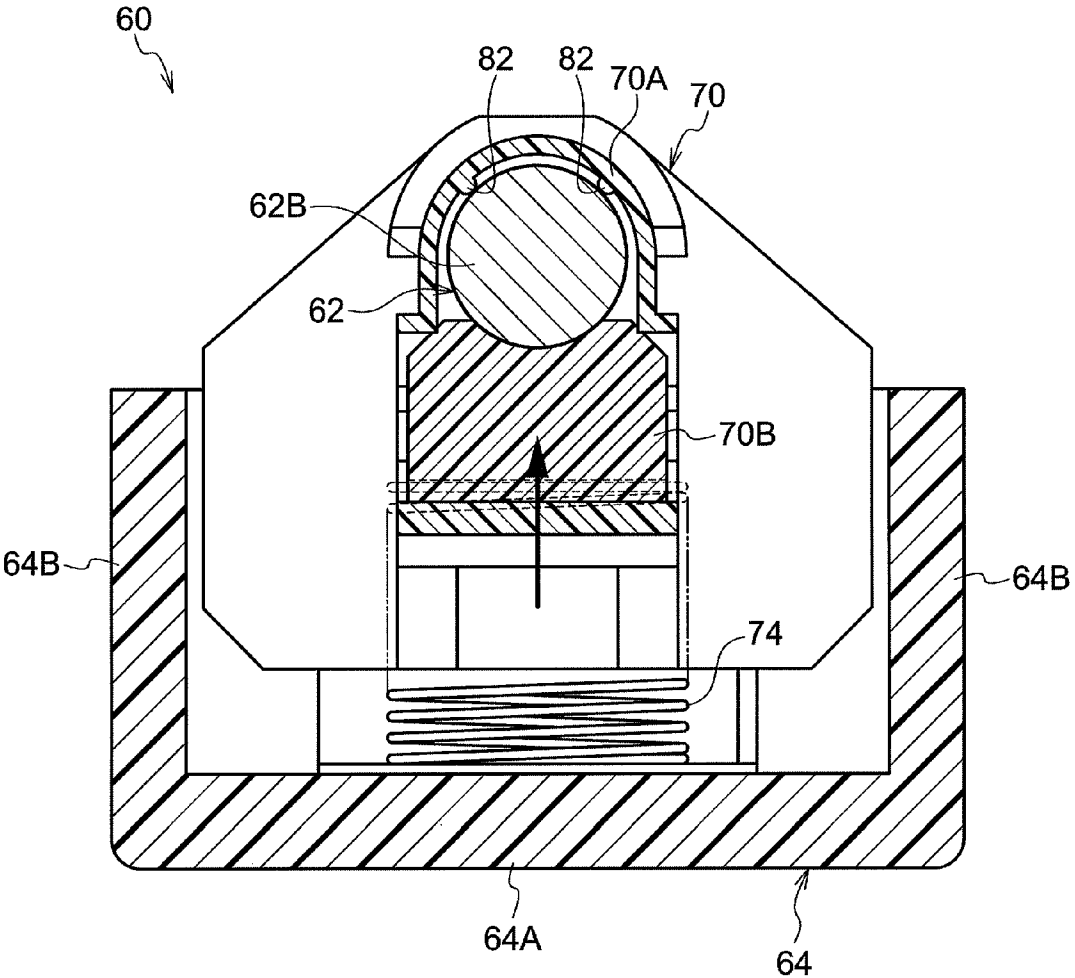
FIG. 10 is a schematic cross sectional view showing a modified example of an insulating portion according to an exemplary embodiment of the invention.

In the present exemplary embodiment, it suffices that the contact portion that the insulating member 70A of the supporting body 70 contacts with the first transfer roll 26 is made smaller than the contact portion that the electrically-conducting member 70B contacts with the first transfer roll 26. Therefore, for example, as shown in FIG. 10, a structure in which the shaft portion 26B of the first transfer roll 26 may be supported by plural convex portions 82 formed in the insulating member 70A and projecting toward the shaft portion 26B may also be possible.

Further, the supporting body 70 at the side having a voltage applied thereto is formed by two components, that is, the insulating member 70A and the electrically-conducting member 70B, but may be formed by one component in which the insulating member 70A and the electrically-conducting member 70B are formed in an integrated manner, or may be formed by three or more components.

Figure 11:
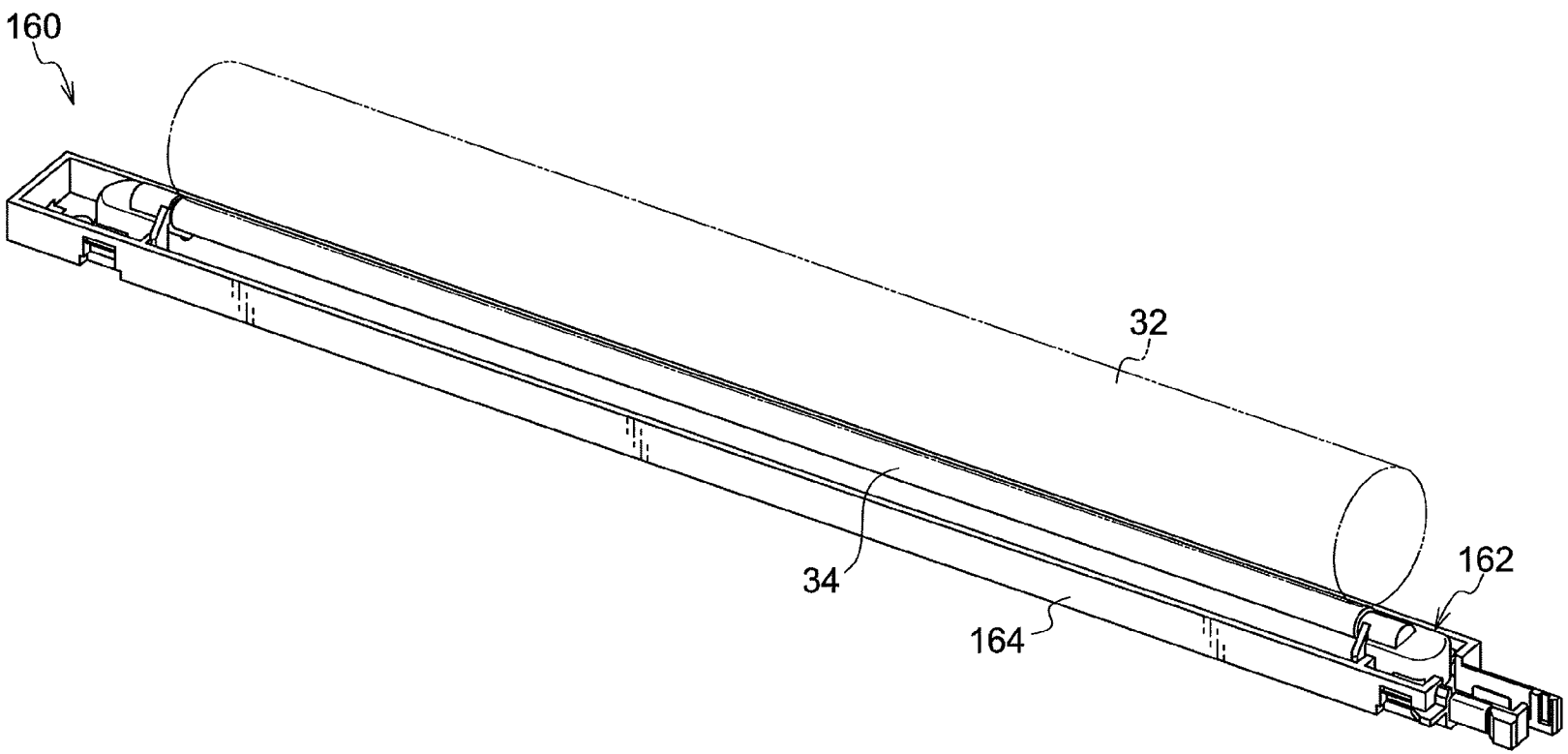
FIG. 11 is a schematic perspective view showing the structure in a case in which the structure of a transfer unit according to an exemplary embodiment of the invention is applied to a charging unit.

Moreover, in the image forming apparatus 10 according to the present exemplary embodiment, the structure of the above-described transfer unit 60 may be applied as a charging unit including the charging roll 34. A charging unit 160 is, as shown in FIG. 11, equipped with a charging roll 34 which is an example of an electrically-conducted roll, a roll supporting mechanism 162 which supports the charging roll 34, and a unit main body 164 in which the roll supporting mechanism 162 is provided. The charging roll 34 is disposed in the state of coming into contact with the outer peripheral surface of the photoreceptor 32. The roll supporting mechanism 162 has the same structure as that of the roll supporting mechanism 62 except that an object to be supported is the first transfer roll 26, and the unit main body 164 has the same structure as that of the unit main body 64. In the configuration in which the structure of the above-described transfer unit 60 is applied as a charging unit, the image forming apparatus 10 may have a structure in which the image forming units 22Y to 22K are respectively provided so as to be removable with respect to the image forming apparatus main body 11 and form an example of an assembly body (a process cartridge) in which the image forming units are assembled integrally in a removable manner. In the image forming units 22Y to 22K, the exposure device 36 and the developing device 38 may also be formed as separate bodies.

Furthermore, the electrically-conducted roll is not limited to the first transfer roll 26 and the charging roll 34. For example, a power-supplied roll to which power is supplied, specifically, a removing roll (a cleaning roll) which removes foreign substances from the power-supplied roll by electrostatic power caused by supply of power, or the like may be used, and the roll supporting mechanism 62 according to the present exemplary embodiment may be applied to the power-supplied roll and the removing roll.

Further, the foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roll supporting mechanism rotatably supporting an electrically-conductive roll, the roll supporting mechanism comprising:

an electrically-conductive portion that contacts with one circumferential portion of an outer periphery of the electrically-conductive roll to conduct electricity to the electrically-conductive roll, an insulating portion that contacts with another circumferential portion of the outer periphery of the electrically-conductive roll at a contact portion smaller than a contact portion of the electrically-conductive portion and that is formed by an insulating material, and a pressing member that presses the electrically-conductive portion against the electrically-conductive roll, wherein the pressing member presses the electrically-conductive portion against the electrically-conductive roll further toward the outer side in the rotation-axis direction of the electrically-conductive roll than the contact portion at which the electrically-conductive roll and the electrically-conductive portion contact with each other.

2. The roll supporting mechanism according to claim 1, wherein the pressing member conducts electricity to the electrically-conductive portion.

3. An image forming apparatus comprising:

an image holding body that holds an image;

a transfer body to which the image is transferred;

a transfer roll serving as an electrically-conductive roll, that transfers the image from the image holding body to the transfer body by application of a voltage;

the roll supporting mechanism according to claim 1, that rotatably supports the transfer roll by the electrically-conductive portion and the insulating portion and that applies the voltage to the transfer roll via the electrically-conductive portion.

4. An image forming apparatus comprising:

a charging roll serving as an electrically-conductive roll, that charges a charged body by application of a voltage;

an exposure device that exposes the charged body charged by the charging roll so as to form a latent image;

a developing device that develops the latent image formed by the exposure device;

the roll supporting mechanism according to claim 1, that rotatably supports the charging roll by the electrically-conductive portion and the insulating portion and that applies the voltage to the charging roll via the electrically-conductive portion.

5. An assembly body being assembled integrally and removably with an apparatus main body, the assembly body comprising:

an image holding body that holds an image, a transfer body to which the image is transferred, a transfer roll serving as the electrically-conductive roll, that transfers the image from the image holding body to the transfer body by application of a voltage, and the roll supporting mechanism according to claim 1 that rotatably supports the transfer roll by the electrically-conductive portion and the insulating portion and that applies the voltage to the transfer roll via the electrically-conductive portion.

6. An assembly body being assembled integrally and removably with an apparatus main body, the assembly body comprising:

a charging roll serving as the electrically-conductive roll, that charges a charged body by application of a voltage, and the roll supporting mechanism according to claim 1, that rotatably supports the charging roll by the electrically-conductive portion and the insulating portion and that applies the voltage to the charging roll via the electrically-conductive portion.

7. A roll supporting mechanism rotatably supporting an electrically-conductive roll, the roll supporting mechanism comprising:

an electrically-conductive portion that contacts with one circumferential portion of an outer periphery of the electrically-conductive roll to conduct electricity to the electrically-conductive roll, an insulating portion that contacts with another circumferential portion of the outer periphery of the electrically-conductive roll at a contact portion smaller than a contact portion of the electrically-conductive portion and that is formed by an insulating material, wherein the electrically-conductive portion has a curved surface portion that contacts with the outer periphery of the electrically-conductive roll, and the insulating portion has a pair of contact portions, each of which contacts with the outer periphery of the electrically-conductive roll, and a curved surface portion whose curvature changes from one of the contact portions to the other of the contact portions along the outer periphery of the electrically-conductive roll and that does not contact with the outer periphery of the electrically-conductive roll.

8. The roll supporting mechanism according to claim 7, wherein the curved surface portion of the insulating portion has a curvature larger than that of the outer periphery of the electrically-conductive roll.

9. The roll supporting mechanism according to claim 7, wherein each contact portion of the insulating portion is a planar surface portion that is formed in a linear shape and is connected to the curved surface portion of the insulating portion.

10. The roll supporting mechanism according to claim 7, wherein each contact portion of the insulating portion has a curved surface whose curvature is smaller than that of the outer periphery of the electrically-conductive roll.

11. The roll supporting mechanism according to claim 7, wherein the contact portion of the electrically-conductive portion is plurally formed along the axial direction of the electrically-conductive roll.

* * * * *